US006678981B1

(12) United States Patent
Shoen et al.

(10) Patent No.: US 6,678,981 B1
(45) Date of Patent: Jan. 20, 2004

(54) FENDER WITH INDICIUM

(75) Inventors: Mark Shoen, Scottsdale, AZ (US); Mark Rafferty, Glendale, AZ (US)

(73) Assignee: U-Haul International, Inc., Tempe, AZ (US)

( * ) Notice: Subject to any disclaimer, the term of this patent is extended or adjusted under 35 U.S.C. 154(b) by 0 days.

(21) Appl. No.: 09/193,010

(22) Filed: Nov. 16, 1998

(51) Int. Cl.[7] ..... G09F 21/04

(52) U.S. Cl. ..... 40/591; 40/587; 40/590; 296/182; 296/168; D12/101; D12/106

(58) Field of Search ..... 40/591, 590, 587; 296/182, 168; 280/847; D12/101, 102, 106, 184, 185

(56) References Cited

U.S. PATENT DOCUMENTS 1,954,919 A * 4/1934 Carey ..... 40/591
2,843,954 A * 7/1958 Rheeling ..... 40/591
3,255,542 A * 6/1966 De Vane ..... 40/591
3,380,607 A * 4/1968 Dale ..... 296/168 X
4,261,329 A * 4/1981 Walsh et al. ..... 296/182 X
4,280,293 A * 7/1981 Kovalenko et al. ..... 40/591 X
4,735,427 A * 4/1988 Fuchs ..... 280/847
4,790,087 A * 12/1988 Hamada et al. ..... 40/204
4,958,451 A * 9/1990 Iwakura et al. ..... 40/204
5,171,037 A * 12/1992 Thompson et al. ..... 280/770
5,255,464 A * 10/1993 Marecek ..... 40/591
5,424,924 A * 6/1995 Ewing et al. ..... 40/591 X
5,570,898 A * 11/1996 Albert ..... 280/656
5,622,389 A * 4/1997 Courtney ..... 40/591 X
5,816,616 A * 10/1998 Boyd ..... 280/847
6,109,639 A * 8/2000 Blassingame et al. .... 40/591 X
D433,352 S * 11/2000 Boyd ..... D12/106

OTHER PUBLICATIONS

NASCAR Craftsman Truck Series, "Truck Comparison".*
Cars Online, "1996 Harley Pro Street".*
UHAUL, "DEMCO Tow Dolly".*

* cited by examiner

*Primary Examiner*—Lynne H. Browne
*Assistant Examiner*—James M. Hewitt
(74) *Attorney, Agent, or Firm*—Jeffer, Mangels, Butler & Marmaro LLP

(57) ABSTRACT

A fender having an inner side wall depending downwardly therefrom, wherein at least one advertising indicium is disposed on the inner side wall, the advertising indicium encompassing substantially the entire surface area of the inner side wall.

19 Claims, 3 Drawing Sheets

FENDER WITH INDICIUM

FIELD OF THE INVENTION

The present invention relates to fenders, such as trailer fenders, and more particularly to a trailer fender having a surface with at least one indicium disposed thereon.

BACKGROUND OF THE INVENTION

A trailer typically includes one or more pairs of wheels and a plurality of fenders that at least partially enclose the wheels of the trailer. The fenders typically have a curved upper surface and flat side walls. Although the walls and upper surface of the fender perform the primary function of protecting the wheels of the trailer, they presently are not otherwise utilized.

A need exists for a fender that usefully employs its external surface area. A need also exists for a trailer that includes such fenders.

SUMMARY OF THE PREFERRED EMBODIMENTS

In accordance with one aspect of the present invention, there is provided a fender having at least one surface, and at least one indicium disposed on said surface.

Preferably, the inventive fender includes a curved upper portion and at least one side wall, more preferably two side walls, and at least one indicium disposed on at least one of said curved upper portion and said at least one side wall.

In a preferred embodiment, the indicium is an advertisement for a product or service. More preferably, the advertisement is disposed on an area which encompasses substantially the entire surface area of the at least one surface.

In accordance with another aspect of the present invention, there is provided a combination of a trailer and at least one fender as described herein.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Conventional fender shapes and designs are well known in the art, and the fender illustrated herein is to be considered exemplary and not limiting in any way. As illustrated herein, the fender is provided in combination with a trailer for towing objects, such as automobiles. However, neither the type of trailer nor the object which can be towed thereon is meant to be a limitation on the present invention. The fender can be used on trailers having any number of wheels or axles, for example, a TOW DOLLY$^{SM}$, commercially available from U-Haul International, Inc., which has two wheels rotatably mounted on one axle, or an AUTO TRANSPORT$^{SM}$, commercially available from U-Haul International, Inc., which has four wheels, two each rotatably mounted on two axles. The fender can be used on trailers provided for towing automobiles, trucks, boats, motorcycles, personal watercraft, heavy equipment, motor homes, etc.

Figure 1:
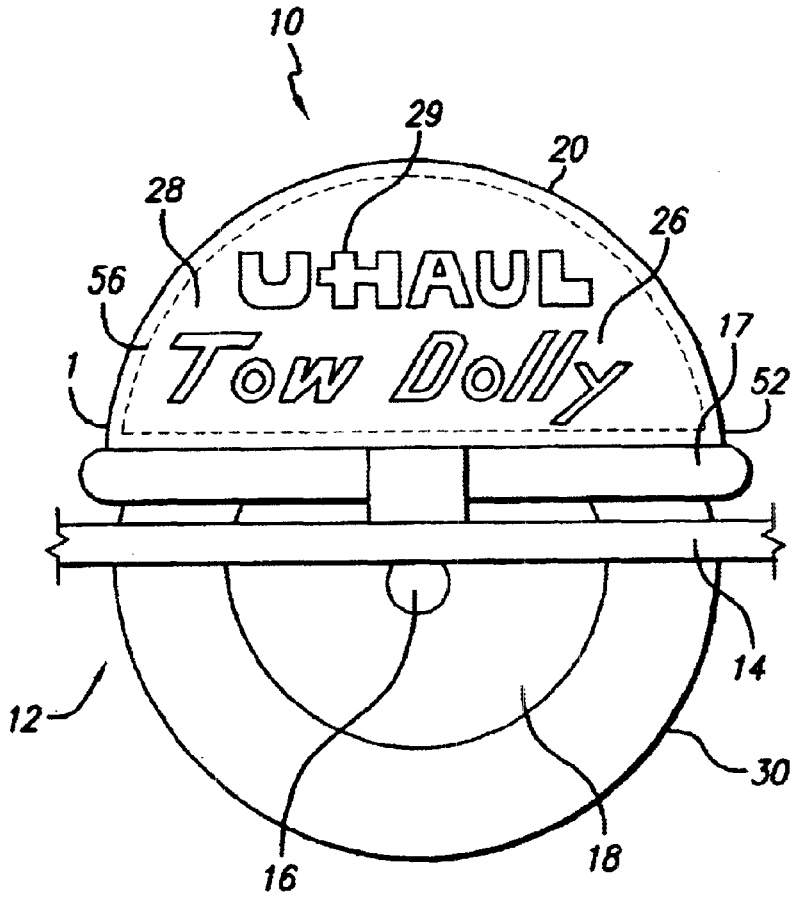
FIG. 1 is a side elevation of a fender including an advertisement mounted on a trailer in accordance with a first embodiment of the present invention.
Figure 2:
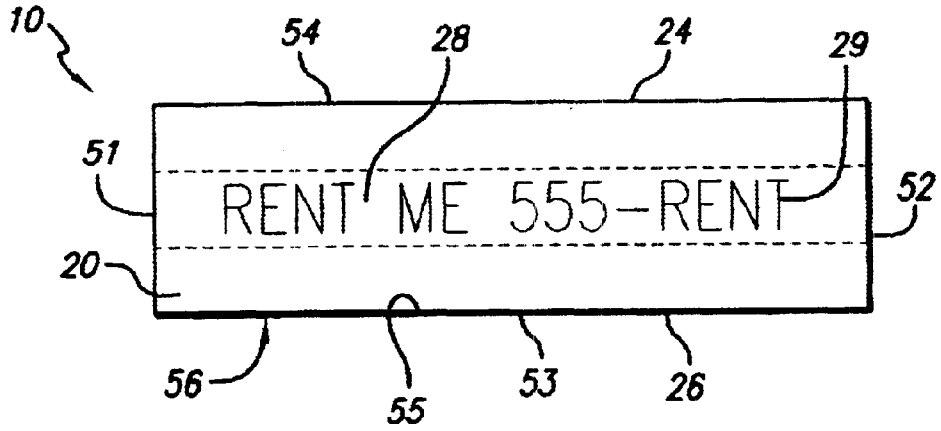
FIG. 2 is a top plan view of the fender of FIG. 1.

In FIGS. 1 and 2, fender 10 includes top portion 20 and opposed outer and inner vertical walls 24 and 26. At least one of the surfaces 20, 24 and 26 (inner surface 26 is illustrated in FIG. 1, top portion 20 in FIG. 2) includes an area 28 in which an indicium 29 is disposed. Area 28 can encompass substantially the entire surface (see FIG. 1) or a portion of the surface (see FIG. 2). "Substantially the entire surface area" as used herein denotes that only an insignificant portion of the surface, for example a narrow border strip, is not covered by the selected indicium.

FIG. 1 also shows the appearance of fender 10 as mounted on a trailer 12, including a frame 14, an axle 16 and a mounting bracket 17.

Figure 3:
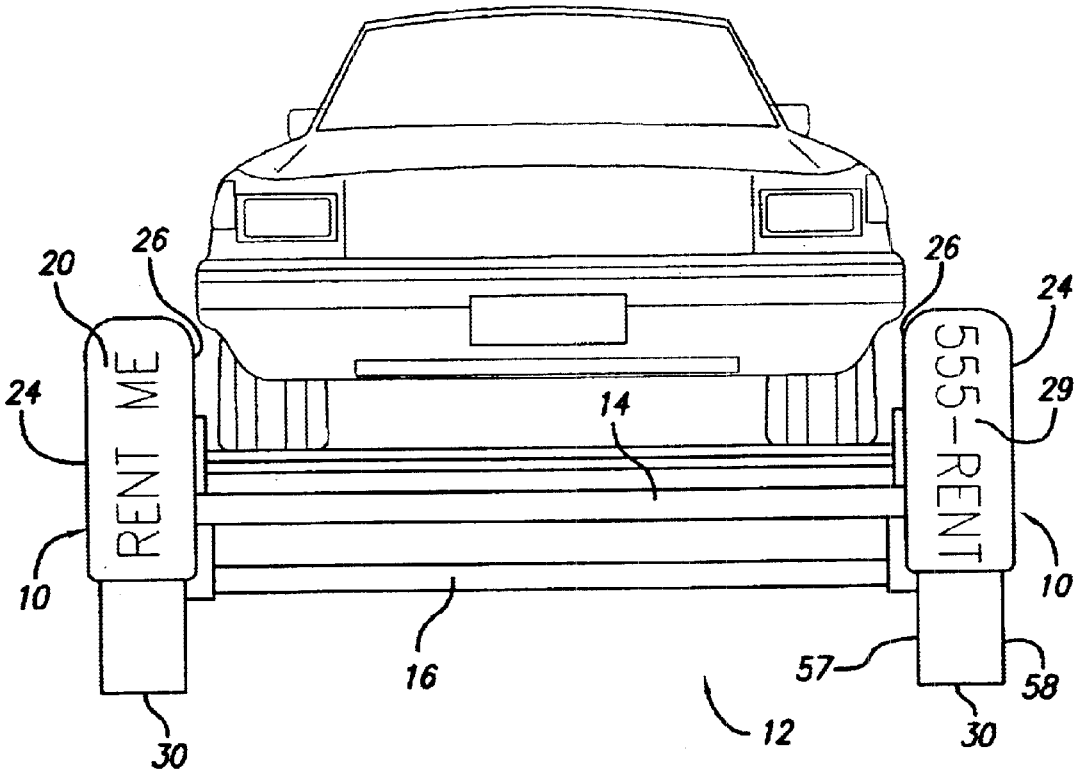
FIG. 3 is a rear view of an auto trailer having two fenders which include an indicium in accordance with a first embodiment of the present invention.

As best shown in FIG. 2, the top portion 20 includes first and second ends 51, 52, and inner and outer edges 53, 54. The inner vertical wall 26 has a first surface 55 and a second surface 56. As best shown in FIG. 3, the tires 30 each have an inner face 57 and outer face 58.

An "indicium" as used herein denotes any visual representation or depiction, and includes, without limitation, letters, numbers, words, phrases, pictorial representations, etc., that convey visual information to an observer other than information pertaining to the operation of the vehicle to which the fender is attached. Preferably, the indicium is an advertisement for a product or a service. The advertisements can be directed to products or services of the vehicle owner, such as a depiction of the name of the vehicle to which the fender is attached or a solicitation to rent or purchase the vehicle. The advertisements can also be directed to products or services of one or more parties other than the vehicle owner.

In a particular embodiment, the area 28 on which the indicium 29 is disposed can be a color different from the fender, thus forming a background for the indicium.

The elements of the fender 10 (the top portion 20, the outer vertical wall 24, and the inner vertical wall 26) preferably are comprised of a rigid material, for example, a metal such as stainless steel or aluminum, a plastic, fiberglass, etc. Also, fender 10 can be formed as one continuous piece, or two or more separate elements can be attached to one another by a conventional attachment method such as welding, fastening with bolts or the like.

As shown in FIG. 3, the conventional auto trailer 12 includes frame 14 having at least one axle 16 with wheels 18 and tires 30 rotatably mounted at opposite ends thereof. Fenders 10 are secured to the frame 14 and over the tires 30 by a conventional method, such as welding. Alternatively, the fender 10 can be secured to the frame by using securing means, such as threaded fasteners, rivets or the like. The fenders 10 also can be integral with the trailer. It should be understood that a right-side fender is typically a mirror image of a left-side fender.

Figure 4:
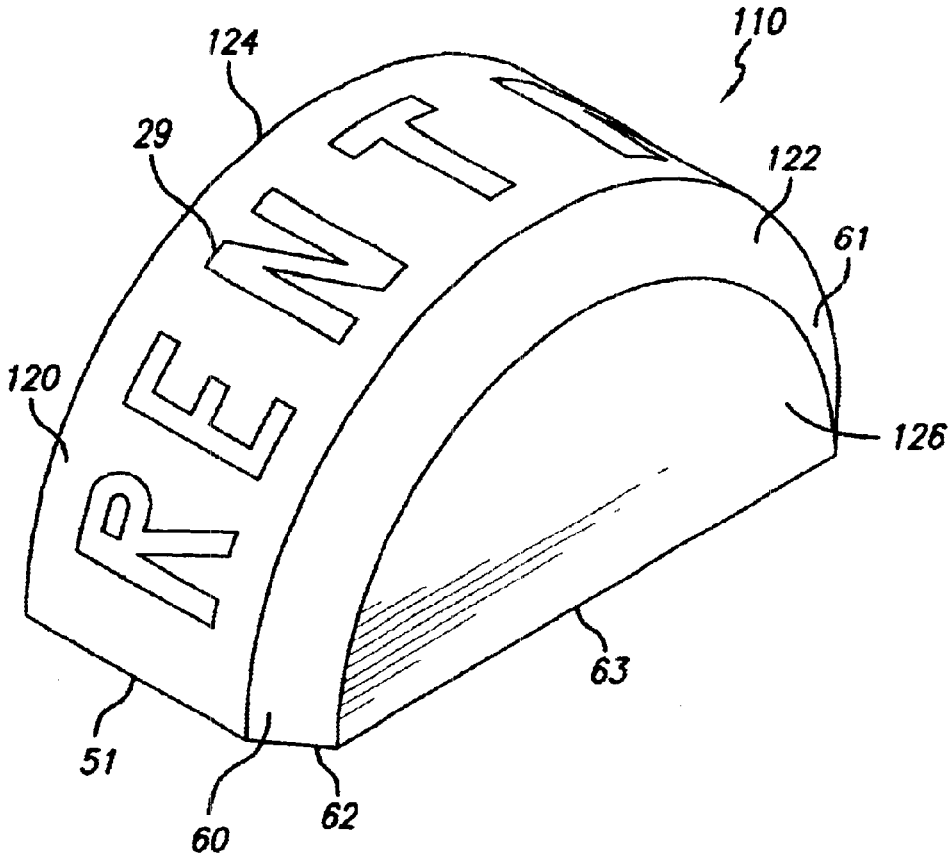
FIG. 4 is a perspective view of a beveled edge fender including an advertisement in accordance with a first embodiment of the present invention.

As best shown in FIG. 4, the clearance increasing portion 122 has first and second ends 60, 61 and bottom edge 62. The inner and outer vertical walls 126, 128 each have a bottom edge 63.

In an alternative embodiment illustrated in FIG. 4, fender 110 includes a clearance increasing portion 122 between top portion 120 and inner vertical wall 126 in the manner described in copending, commonly assigned U.S. patent application Ser. No. 09/557,459. The clearance increasing portion 122 allows wider objects, such as a car, to fit onto the trailer than would otherwise be possible without it. Fender 110 includes at least one indicium 28 disposed on at least one of the surfaces 120, 122, 124 and 126.

Figure 5:
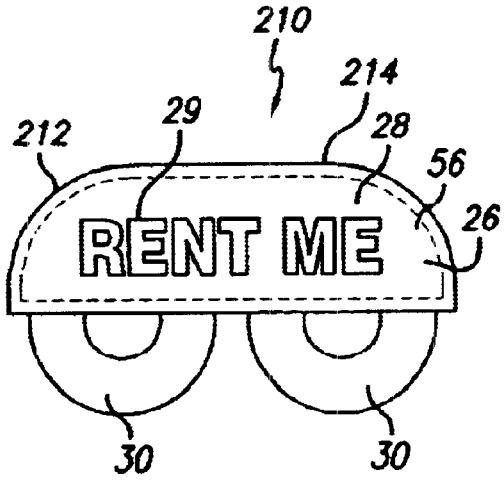
FIG. 5 is a side elevation of an alternative embodiment of a fender according to the invention.

Another alternative embodiment according to the invention is illustrated in FIG. 5. Fender 210 is provided for at least partially surrounding two tires 30. The fender 210 includes a top portion 212 that preferably has a substantially flat middle section 214 and curved end sections. Alternatively, the top portion 212 can include a plurality of planar sections that connect at angles. The fender 210 can also include a clearance increasing portion as described above.

What is claimed is:

1. A fender comprising an inner side wall depending downwardly therefrom, wherein at least one advertising indicium is disposed on said inner side wall, the advertising indicium encompassing substantially the entire surface area of said inner side wall.

2. The fender of claim 1 further comprising an upper portion, wherein the advertising indicium is also disposed on the upper portion.

3. The fender of claim 2 further comprising an outer side wall.

4. The fender of claim 2 wherein the upper portion is curved, the fender comprising a clearance increasing portion between said inner side wall and said curved upper portion, wherein said clearance increasing portion forms an angle where it meets said inner side wall, wherein said clearance increasing portion forms an angle where it meets said upper portion, and said fender further comprising an outer side wall.

5. The fender of claim 1 wherein said advertising indicium is an advertisement for a product or service.

6. A vehicle comprising a trailer and at least one fender of claim 1.

7. The fender of claim 3 wherein said outer side wall has at least one advertising indicium disposed thereon.

8. A trailer including at least one fender of claim 1.

9. A trailer comprising:

a) at least two tires, wherein said at least two tires each have an inner face and an outer face, and b) at least one fender, wherein said fender comprises i) an upper portion having opposed inner and outer edges, ii) an inner side wall depending downwardly from said inner edge of said upper portion, said inner side wall having a first and second surfaces, wherein said first surface of said inner side wall is adjacent said inner face of one of said at least two tires, and iii) at least one advertising indicium disposed on said second surface of said inner side wall, wherein said inner side wall and said upper portion each have a surface area, and wherein said advertising indicium is disposed on an area which encompasses substantially the entire surface area of said inner side wall.

10. The fender of claim 9 wherein said indicium is also disposed on said upper portion.

11. A fender comprising an upper portion and an inner side wall depending downwardly therefrom, wherein said inner side wall has first and second surfaces, wherein said second surface faces away from said upper portion, and wherein an advertising indicium is disposed on said second surface of said inner side wall and encompasses substantially the entire second surface of the inner side wall.

12. The fender of claim 11 wherein said advertising indicium is also disposed on said upper portion.

13. A fender comprising a) an upper portion having opposed inner and outer edges and having first and second opposite ends each having a bottom edge, b) an inner side wall depending downwardly from said inner edge of said upper portion, said inner side wall having first and second surfaces, wherein said second surface of said inner side wall faces away from said upper portion, and said inner side wall having a bottom edge, c) an outer side wall depending downwardly from said outer edge of said upper portion, said outer side wall having a bottom edge, and d) at least one indicium disposed on said second surface of said inner side wall, wherein said at least one indicium is disposed on an area which encompasses substantially the entire surface area of said second surface of said inner side wall, and wherein said bottom edges of said opposite ends of said upper portion, said bottom edge of said outer side wall and said bottom edge of said inner side wall cooperate to form a continuous edge and lie in a common plane.

14. A fender comprising:

an upper portion having opposed inner and outer edges;

an inner side wall depending downwardly from the inner edge of the upper portion;

an outer side wall depending downwardly from the outer edge of the upper portion wherein the inner side wall and outer side wall are spaced apart and have the same shape; and at least one advertising indicium disposed on said inner side wall, wherein the advertising indicium encompasses substantially the entire surface area of said inner side wall.

15. A fender comprising:

an upper portion having opposed inner and outer edges, and opposed first and second ends;

an inner side wall depending downwardly from the inner edge of the upper portion and contained within the first and second ends of the upper portion;

an outer side wall depending downwardly from the outer edge of the upper portion and contained within the first and second ends of the upper portion and in contact with both the first and second ends of the upper portion;

at least one advertising indicium disposed on said inner side wall, wherein the advertising indicium encompasses substantially the entire surface area of said inner side wall.

16. A fender adapted to partially surround a tire, the fender comprising:

an upper portion having a first end and a second end, opposed inner and outer edges, and a curved shape that at least partially surrounds the tire;

an inner side wall depending downwardly from the inner edge of the upper portion and confined within the first and the second ends of the upper portion;

an outer side wall depending downwardly from the outer edge of the upper portion and contained within the first and second ends of the upper portion and in contact with both the first and second ends of the upper portion; and at least one advertising indicium disposed on said inner side wall, the advertising indicium encompasses substantially the entire surface area of said inner side wall.

17. A fender, comprising:

an upper portion having a first end and a second end;

an inner side wall confined within the first end and the second end of the upper portion and depending downwardly therefrom; and, least one advertising indicium disposed on said inner side wall, wherein the advertising indicium encompasses substantially the entire surface area of said inner side wall.

18. A fender comprising:

a) an upper portion having opposed inner and outer edges, b) an inner side wall depending downwardly from said inner edge of said upper portion, and c) at least one advertising indicium disposed on said inner side wall, wherein the advertising indicium encompasses substantially the entire surface area of said inner side wall.

19. The fender of claim 18 wherein said advertising indicium is also disposed on said upper portion.

* * * * *